US011820645B2

(12) United States Patent
Larsson

(10) Patent No.: US 11,820,645 B2
(45) Date of Patent: Nov. 21, 2023

(54) FUEL DISPENSER WITH CONTROL SYSTEM INSIDE THE HYDRAULIC COMPARTMENT

(71) Applicant: Wayne Fueling Systems Sweden AB, Malmö (SE)

(72) Inventor: Bengt I. Larsson, Skivarp (SE)

(73) Assignee: Wayne Fueling Systems Sweden AB, Malmö (SE)

( * ) Notice: Subject to any disclaimer, the term of this patent is extended or adjusted under 35 U.S.C. 154(b) by 0 days.

(21) Appl. No.: 17/757,613

(22) PCT Filed: Dec. 14, 2020

(86) PCT No.: PCT/EP2020/085952
§ 371 (c)(1),
(2) Date: Jun. 17, 2022

(87) PCT Pub. No.: WO2021/122445
PCT Pub. Date: Jun. 24, 2021

(65) Prior Publication Data

US 2023/0014660 A1 Jan. 19, 2023

(30) Foreign Application Priority Data

Dec. 20, 2019 (SE) ..... 1951525-3

(51) Int. Cl.
*B67D 7/04* (2010.01)
*B67D 7/16* (2010.01)
*B67D 7/62* (2010.01)

(52) U.S. Cl.
CPC ..... *B67D 7/04* (2013.01); *B67D 7/16* (2013.01); *B67D 7/62* (2013.01)

(58) Field of Classification Search
CPC ..... B67D 7/04; B67D 7/16; B67D 7/62
See application file for complete search history.

(56) References Cited

U.S. PATENT DOCUMENTS 4,930,665 A * 6/1990 Devine ..... G05D 7/0688 251/129.08
5,867,403 A * 2/1999 Sasnett, Jr. ..... B67D 7/303 141/2

(Continued)

FOREIGN PATENT DOCUMENTS

EP 1932802 A1 * 6/2008 ..... B67D 7/84
EP 1932802 A1 6/2008

(Continued)

OTHER PUBLICATIONS

International Search Report and Written Opinion of International Application No. PCT/EP2020/085952 dated Mar. 10, 2021, 10 pages.

*Primary Examiner* — Timothy L Maust
(74) *Attorney, Agent, or Firm* — MINTZ LEVIN COHN FERRIS GLOVSKY AND POPEO, PC

(57) ABSTRACT

The invention relates to a fuel dispenser (1) comprising a hose storage space (2) adapted to accommodate at least one fuel hose (3), an electronic compartment (4) containing a main frame control unit (5), and a hydraulic compartment (6) containing fuel dispensing means (22) for dispensing fuel into a vehicle reservoir. According to the invention, the hydraulic control unit (7) is located inside the hydraulic compartment (6) and is electrically connected to the main-frame control unit (5) by a main electric cable means (17). The invention also relates to a method for handling a fuel dispenser (1).

14 Claims, 2 Drawing Sheets

(56) References Cited

U.S. PATENT DOCUMENTS

| | | | | | |
|---|---|---|---|---|---|
| 5,941,418 | A * | 8/1999 | Box | B67D 7/04 | 222/255 |
| 6,651,706 | B2 * | 11/2003 | Litt | B67D 7/106 | 141/234 |
| 7,147,015 | B1 * | 12/2006 | Durham | B67D 7/04 | 141/105 |
| 9,038,856 | B2 * | 5/2015 | Larsson | B67D 7/62 | 222/74 |
| 10,703,622 | B2 * | 7/2020 | Carapelli | G01N 29/024 | |
| 2003/0028285 | A1 | 2/2003 | Zura et al. | | |
| 2010/0139782 | A1 | 6/2010 | Deline et al. | | |
| 2018/0009651 | A1 | 1/2018 | Payne et al. | | |
| 2018/0209940 | A1 | 7/2018 | Carapelli et al. | | |

FOREIGN PATENT DOCUMENTS

| | | | | | |
|---|---|---|---|---|---|
| EP | 2157045 | A1 * | 2/2010 | B67D 7/08 | |
| EP | 2606544 | A1 | 6/2013 | | |
| EP | 3395753 | A1 * | 10/2018 | B67D 7/04 | |
| EP | 3395753 | A1 | 10/2018 | | |
| EP | 3395754 | A1 | 10/2018 | | |
| WO | WO-2015187976 | A2 * | 12/2015 | B67D 7/04 | |

* cited by examiner

FUEL DISPENSER WITH CONTROL SYSTEM INSIDE THE HYDRAULIC COMPARTMENT

CROSS-REFERENCE TO RELATED APPLICATIONS

This application is a national stage application, filed under 35 U.S.C. § 371, of International Patent Application No. PCT/EP2020/085952 filed on Dec. 14, 2020, which claims priority to Swedish Application Serial No. SE1951525-3, filed on Dec. 20, 2019. The entire contents of these applications are incorporated by reference herein in their entirety.

TECHNICAL FIELD

The invention relates to a fuel dispenser for refueling vehicles and a method for handling a fuel dispenser.

BACKGROUND ART

When passing a cable through a first and a second surface, the criteria of sealing that cable in relation to said two surfaces naturally differ depending of the environmental circumstances. If the surfaces are part of an arrangement handling an inflammable substance, such as a fuel dispensing unit, the criteria of the sealing is high.

It is well-known that fuel, such as petrol or diesel, is a highly inflammable substance that must be handled with extreme care. An inherent property of fuel, that increases the risks of its handling, is its high volatility. For the above reasons, safety standards such as the UL standards for safety in North America and the ATEX directive have been created for fuel handling in order to reduce the thereby induced risks.

Fuel dispensers generally comprise electronics in order for the user to be able to control the hydraulic of the fuel dispensing unit and refuel e.g. a vehicle. The electronics of the fuel dispensing unit can provide an increased risk in that for instance sparks from electronic circuitry and/or heat radiated from the electronic wiring and circuitry could ignite the fuel vapors.

The hydraulic components and the electronics of a fuel dispenser are located in separate compartments or modules. However, in order to make the fuel dispenser operational it is necessary to pull cables between the hydraulic compartment and the electronic compartment, thereby risk leading inflammable substance from the hydraulic compartment up and into the electronic compartment.

There is a number of different solutions for sealing a cable available on the market today. The technique used today is based on mounting the sealing device after the cable has been positioned. The cable to be sealed must be pulled through the surfaces in question before a gasket and some kind of sealing element is provided for each surface passed by the cable.

A problem with sealing devices for cables according this technique and other prior art is the vast amount of parts involved as well as the mounting of the same. This procedure is both troublesome and time consuming.

SUMMARY OF THE INVENTION

It is an object of the present invention to provide an improvement of the fuel dispensers according to prior art. A particular object is to provide a fuel dispenser with a minimum number of cables drawn between the hydraulic compartment and the electronic compartment.

According to a first aspect, these and other objects, and/or advantages that will be apparent from the following description of embodiments, are achieved, in full or at least in part, by a fuel dispenser for refueling vehicles. The fuel dispenser comprises a hose storage space adapted to accommodate at least one fuel hose, an electronic compartment containing a main frame control unit, and a hydraulic compartment containing fuel dispensing means for delivering fuel into a vehicle reservoir. The fuel dispenser comprises a hydraulic control unit controlling the fuel dispensing means. The hydraulic control unit is located inside the hydraulic compartment and electrically connected to the main frame control unit by a main electric cable means.

This is advantageous in that the number of cables needed to be drawn between the hydraulics compartment and the electronics compartment is minimized. In turn, it will be extremely difficult to manipulate the fuel dispensing unit since the sensitive operations are conducted within the hydraulics compartment and are merely communicated up to the electronics compartment.

The fuel dispensing means may comprise at least a flow meter adapted to measure the fuel flow in the at least one fuel hose, and at least a control valve adapted to control the fuel flow in the at least one fuel hose based on the fuel flow measured by the flow meter. The flow meter and control valve may be electrically connected to the hydraulic control unit by second electric cable means.

The fuel dispensing means may comprise at least a fuel dispensing unit comprising a pump motor driving a pump, a flow meter adapted to measure the fuel flow delivered by the pump, and a control valve adapted to control the fuel flow delivered based on the fuel flow measured by the flow meter. The pump motor, flow meter and control valve may be electrically connected to the hydraulic control unit by second electric cable means.

The fuel dispensing means may comprise several fuel dispensing units that are each electrically connected to a distinct hydraulic control unit.

The hydraulic control units may be electrically connected in series by third electric cable means, one of the hydraulic control units being connected to the main frame control unit by a single main electric cable means.

This new concept will further decrease the number of cables needed to be drawn between the hydraulics compartment and the electronics compartment, which, in turn, will make the fuel dispensing unit even more extremely difficult to manipulate.

The hydraulic control units may each be electrically connected to the main frame control unit by a distinct main electric cable means.

The main electric cable means, the second electric cable means, and the third electric cable means may comprise each a power alimentation line and a command line.

The main frame control unit may comprise a user interface device adapted to communicate with an external environment.

The hydraulic control unit may comprise at least one sensor adapted to detect magnetic field.

The the at least one sensor may be a Hall effect sensor.

The electronic compartment and the hydraulic compartment may be connected to the hose storage space via a column. The electronic compartment may be arranged above the hydraulic compartment and in contact thereof.

According to a second aspect, the objects are achieved in full, or at least in part, by a method for handling a fuel dispenser. The fuel dispenser comprises a hose storage space adapted to accommodate at least one fuel hose, an electronic compartment containing a main frame control unit, and a hydraulic compartment containing fuel dispensing means for delivering fuel inside a vehicle reservoir. The method comprises the step of controlling the fuel dispensing means via a hydraulic control unit located in the hydraulic compartment. The hydraulic control unit is connected to the main frame control unit of the electronic compartment.

The method may further comprise the steps of communicating with an outer environment of the fuel dispenser, such as a user, via the main frame control unit, and updating the hydraulic control unit accordingly.

The method may further comprise the steps of handling the fuel dispensing means of the hydraulic compartment via the hydraulic control unit, and updating the main frame control unit accordingly.

It should be noted that the different embodiments of the device that is described above are exemplifying only. The embodiments may be combined with each other in any suitable way depending on the requirements established for the fuel dispenser.

Effects and features of the second and third aspects of the present invention is largely analogous to those described above in connection with the first aspect the inventive concept. Embodiments mentioned in relation to the first aspect of the present invention are largely compatible with the further aspects of the invention.

Other objectives, features and advantages of the present invention will appear from the following detailed disclosure, from the attached claims, as well as from the drawings. It is noted that the invention relates to all possible combinations of features.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise.

As used herein, the term "comprising" and variations of that term are not intended to exclude other additives, components, integers or steps.

BRIEF DESCRIPTION OF THE DRAWINGS

The above objects, as well as additional objects, features and advantages of the present invention, will be more fully appreciated by reference to the following illustrative and non-limiting detailed description of preferred embodiments of the present invention, when taken in conjunction with the accompanying drawings, wherein.

DETAILED DESCRIPTION OF PREFERRED EMBODIMENTS OF THE INVENTION

Figure 1:
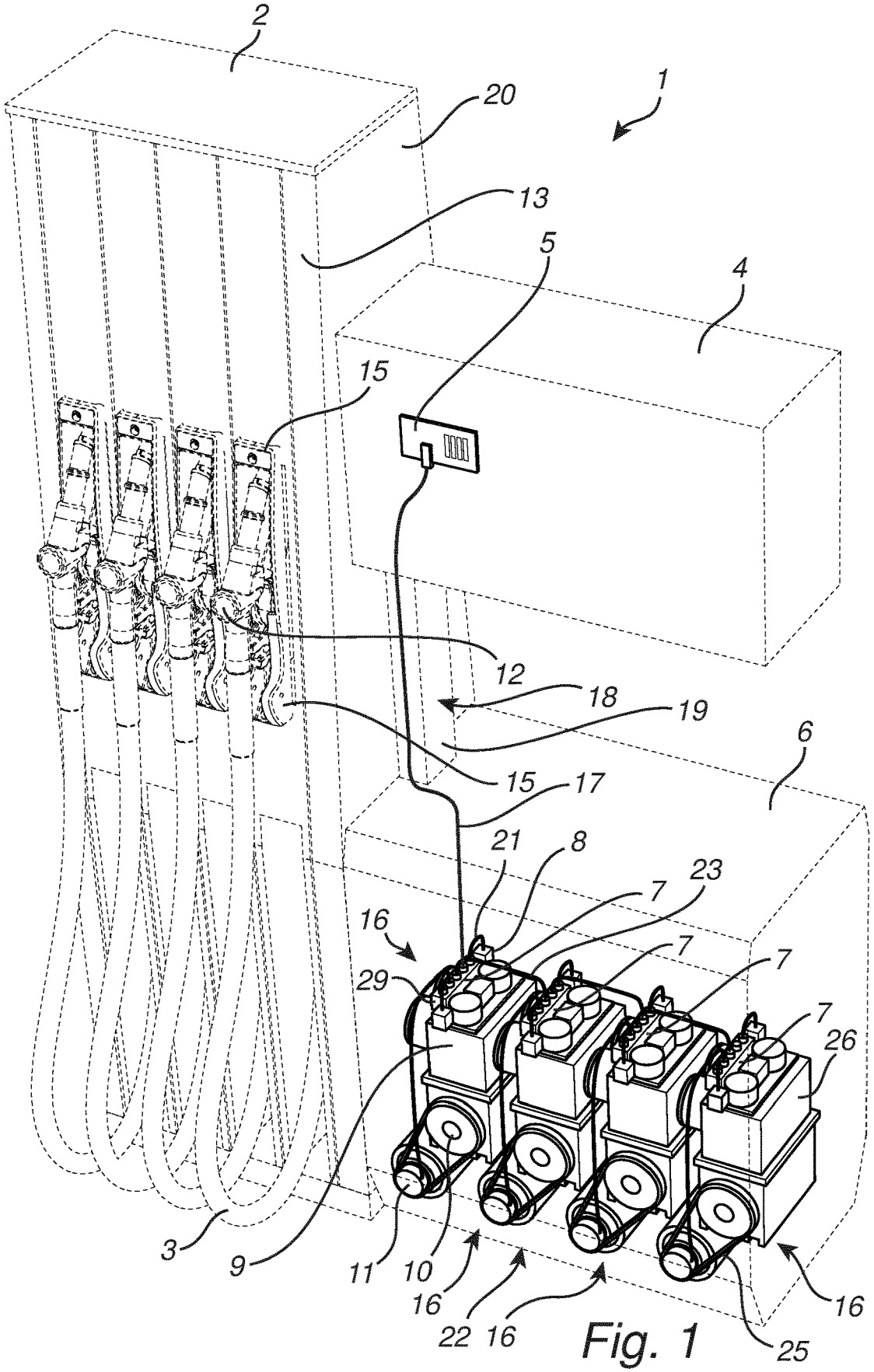
FIG. 1 is a perspective view of an exemplary embodiment of a fuel dispenser according to a first aspect of the invention.

FIG. 1 illustrates an exemplary embodiment of a fuel dispenser 1 for refueling vehicles. The fuel dispenser 1 comprises a hose storage space 2 adapted to accommodate at least a fuel hose 3, an electronic compartment 4 containing a main frame control unit 5 arranged on the inside and a user interface (not shown) arranged on the outside and a hydraulic compartment 6 containing fuel dispensing means 22 for delivering fuel (as gasoline or diesel) into a vehicle reservoir.

The hydraulic compartment 6 houses at least one hydraulic control unit 7 controlling the fuel dispensing means 22. The hydraulic control unit 7 which is located inside the hydraulic compartment 6 is electrically connected to the main frame control unit 5 which is located in the electronic compartment 4, as said above, by a main electric cable means 17.

In the embodiment of FIG. 1, the fuel dispensing means 22 comprises four fuel dispensing units 16 comprising each a pump 10 driven by a pump motor 11 via a belt 25, at least a flow meter 9 measuring the fuel flow delivered and at least a control valve 8 for adjusting the fuel flow rate.

The hydraulic control unit 7 is also electrically connected to the control valve 8, the flow meter 9, the pump 10 and the pump motor 11, by second electric cable means 21. These components are used to control the fuel flow coming from an underground fuel tank, crossing through the hydraulic compartment 6, out through the fuel hose 3, and going through a vehicle tank via a nozzle 12 connected to an end of the fuel hose 3.

The main frame control unit 5 handles the communication with an outer environment of the fuel dispenser 1, such as a user, via the user interface, and updates the hydraulic control unit 7 accordingly.

In turn, the hydraulic control unit 7 handles the fuel dispensing unit 16 which it connected to it and more particularly its hydraulic components such as the control valve 8, the flow meter 9, the pump 10 and the pump motor 11. The hydraulic control unit 7 also updates the main frame control unit 5 accordingly.

As can be seen from FIG. 1, the flow meter 9 and the control valve 8 are directly connected to each other within the hydraulic compartment 6 via the hydraulic control unit 7.

The hydraulic control unit 7 is connected to at least one sensor (not shown) which is adapted to detect magnetic field. The sensor is preferably constituted by a Hall effect sensor. More specifically, the sensor is used to detect a magnetic field which is generated by the flow meter 9 and which correspond to the rotation of the flow meter 9 (in turn proportional to the fuel volume outputted by means of the pump 10).

The hydraulic control unit 7 is positioned above the flow meter 9 cover 26.

Alternatively, the hydraulic control unit 7 is positioned inside the flow meter cover 26.

It a particular embodiment, the electronic card of the hydraulic control unit 7 and the electronic card of the flow meter 9 is a single electronic card. Alternately, the electronic card of the hydraulic control unit 7 and the electronic card of the flow meter 9 is a divided card, such as a so called semi-flex card.

The electronic compartment 4 and the hydraulic compartment 6 are connected to the hose storage space 2 via a column 13. Further, the electronic compartment 4 is arranged above the hydraulic compartment 6.

In alternative embodiments, the electronic compartment 4 may be arranged directly above the hydraulic compartment 6, the electronic compartment 4 being in contact with the hydraulic compartment 6.

The main electric cable means 17 crosses a secure area 18 provided for avoiding fuel vapors coming from the hydraulic compartment 6 to penetrate inside the electronic compartment 4.

Several solutions are available such as foams in close abutment against the cables as described in the patent EP1333007. It enables to provide a safe environment according to ATEX directives.

According to a possible embodiment shown in FIG. 1, the main electric cable means 17 goes along a lateral wall 20 of the hydraulic compartment 6 and is protected by a cover 19. The cover 19 is fixed to the lateral wall 20.

In the example of FIG. 1, the fuel dispenser 1 comprises four fuel dispensing units 16 dispensing each a single type of fuel (SP95 or E85 or diesel for instance).

Each fuel dispensing unit 16 is connected to a distinct hydraulic control unit 7 (one hydraulic control unit 7 per fuel dispensing unit 16). There is thus four hydraulic control unit 7 connected to each other in series. The four fuel dispensing units 16 are thus connected to each other in series by third electric cable means 23, forming a fuel dispensing assembly 22 electrically connected to the main frame control unit 5 via a single main electric cable means 17. Two hydraulic control unit 7 of two respective fuel dispensing units 16 are connected by one third electric cable means 23.

One of the four hydraulic control units 7, that could be called master hydraulic control units 7, is electrically connected to the main frame control unit 5 via the single main electric cable means 17. It thus provides also a connection of the other hydraulic control units 7 to the main frame control unit 5.

Each hydraulic control unit 7 is electrically connected to the control valve 8, the flow meter 9, the pump 10 and the pump motor 11 of a fuel dispensing unit 16, by second electric cable means 21.

Upon a blending refueling process, two separate hydraulic control units 7 which are connected in series may communicate directly with each other without involving the main frame control unit 5 of the electronic compartment 4.

According to another embodiment (not shown), each hydraulic control unit 7 is connected to the main frame control unit 5 by a distinct main electric cable means 17. The fuel dispenser 1 comprises thus four main electric cable means 17 going along the lateral wall 20 of the hydraulic compartment 6 for connecting each hydraulic control units 7 to the main frame control unit 5. The four main electric cable means 17 are protected by the cover 19.

According to another embodiment (not shown), the hydraulic compartment 6 houses a single hydraulic control unit 7 electrically connected to the four fuel dispensing units 16 via electric cables. More precisely each hydraulic component of a fuel dispensing unit 16 as the pump motor, the meter and the valve are connected to the single hydraulic control unit 7 via electric cables.

The single hydraulic control unit 7 is connected to the main frame control unit 5 via a single main electric cable means 17.

The single hydraulic control unit 7 could comprise a multicore processor enabling a separate management of the four fuel dispensing units 16.

No matter the embodiments, the hydraulic control units 7 are advantageously enclosed in an explosion proof enclosure 24 in order to avoid explosion risk inside the hydraulic compartment 6 in case of fuel vapor emission.

The main electric cable means 17, the third electric cable means 23 and the second electric cable means 21 could be CAN Bus, serial communication or any other conventional communication technique.

The main electric cable means 17, the third electric cable means 23 and the second electric cable means 21 comprise each a power alimentation line and at least a command line.

For instance, the power alimentation line of the main electric cable means 17 is connected to a power source enabling to feed the fuel dispensing units 16.

Figure 2:
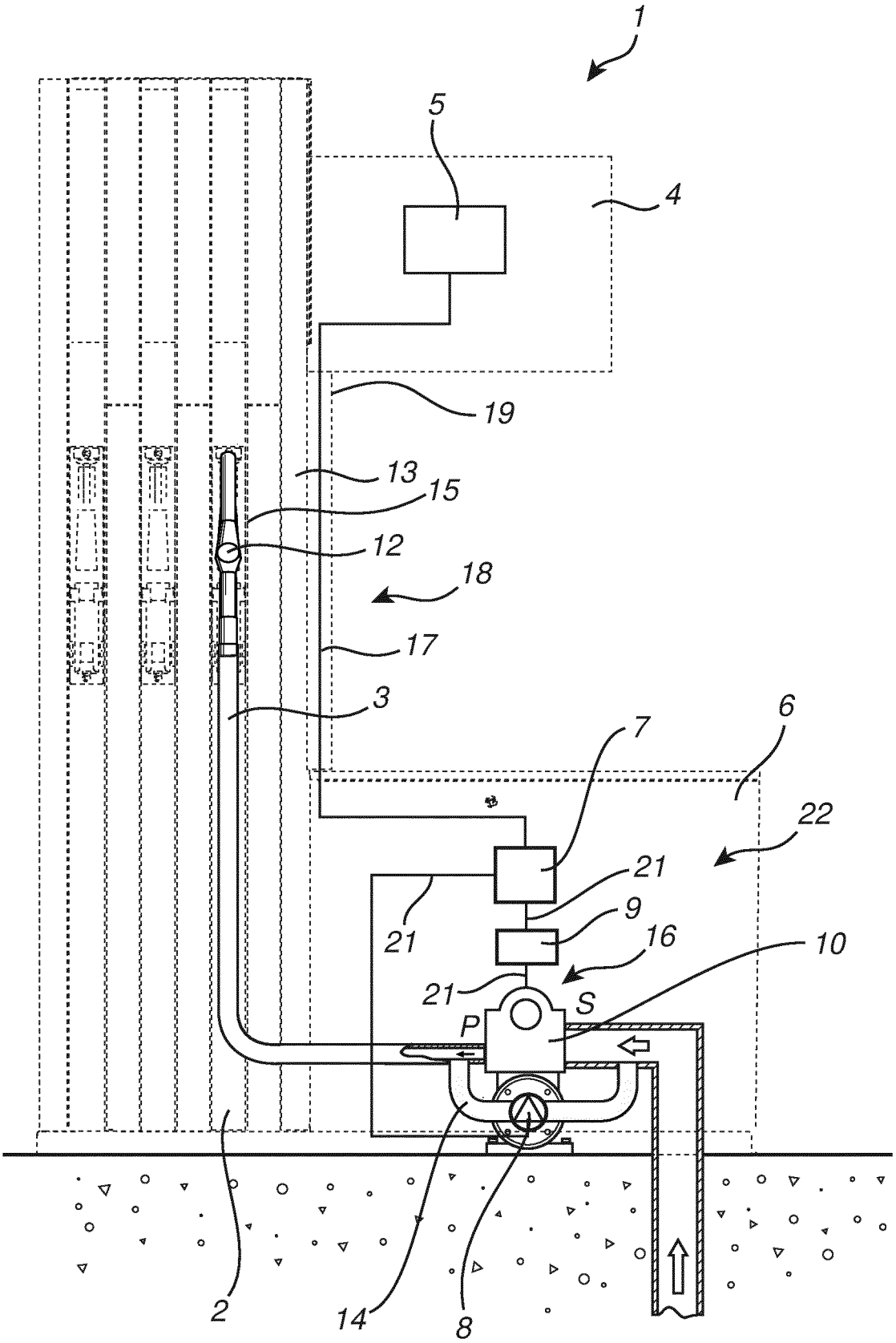
FIG. 2 is a perspective view of another exemplary embodiment of a fuel dispenser according to the first aspect of the invention.

FIG. 2 illustrates an alternative embodiment of the fuel dispenser 1. Also, in this embodiment, the fuel dispenser 1 comprises a hose storage space 2 adapted to accommodate a plurality of fuel hoses 3, an electronic compartment 4 containing a main frame control unit 5 arranged on the inside and a user interface (not shown) arranged on the outside, and a hydraulic compartment 6 containing fuel dispensing means 22. The hydraulic compartment 6 houses a hydraulic control unit 7 controlling the fuel dispensing means 22 in the hydraulic compartment 6.

The fuel dispensing means 22 comprises a fuel dispensing unit 16 comprising a control valve 8, a flow meter 9, a pump 10 and a pump motor 11.

The hydraulic control unit 7 is connected to the main frame control unit 5 via a main electric cable means 17.

The hydraulic control unit 7 is connected to the control valve 8, the flow meter 9, the pump 10 and the pump motor 11 by second electric cable means 21. These components are used to control the fuel flow coming from an underground tank, going through the hydraulic compartment 6, out through the fuel hose 3, and into a vehicle tank via a nozzle 12 connected to an end of the fuel hose 3.

In this embodiment, the pump 10 comprises a bypass channel 14 arranged between the pressure side P and the suction side S of the pump 10. The bypass channel 14 has a control valve 8 which is constituted by a spring valve.

The control valve 8 which is an electronic control valve 8 is electrically connected to the hydraulic control unit 7 by a second electric cable means 21.

The pump 10 is also electrically connected to flow meter 9 by a second electric cable means 21. The flow meter 9 is electrically connected to the hydraulic control unit 7 by a second electric cable means 21.

One exemplary of a refueling process of the fuel dispenser 1 will now be described in more detail. When the nozzle 12 is removed from a nozzle boot 15 of the fuel dispenser 1, the main frame control unit 5 of the electronic compartment 4 is alerted.

The main frame control unit 5 forwards that information (and any user inputted via the user interface) to the hydraulic control unit 7 of the hydraulic compartment 6. From here, the refuelling process is completely handled by the hydraulic control unit 7 and components present in the hydraulic compartment 6. The main frame control unit 5 is merely updated regarding the refuelling process in progress but it is not used to control the same. In other words, all of the real time decisions are made by the hydraulic control units 7.

The hydraulic control unit 6 starts the pump motor 11 driving the pump 10. The pump motor 10 is normally operated at a fixed speed, and therefore, the fuel is circulated from the pressure side P to the suction side S via a bypass channel 14 at full capacity (for example at a rate of 80 litres/minute) until the actual refuelling of a vehicle has started.

When the nozzle 12 is opened and the fuel starts flowing therefrom, a pressure drop will occur and the pressure from the fuel applied on a spring valve present in the bypass channel will decrease. In other words, if the nozzle 12 starts to deliver fuel to a vehicle at a flow rate of 40 litres/minute, the fuel flow rate through the bypass channel 14 will decrease to 40 litres/minute.

When the refuelling process is completed, the main frame control unit 5 of the electronic compartment 4 is updated accordingly by the hydraulic control units 7 located inside the hydraulic compartment 6, such that any necessary information may be present to the user via the user interface present on the outside of the electronic compartment 4.

In another embodiment, the fuel dispenser 1 is in a submerged configuration including a pump submerged in the fuel tank of a petrol station.

The fuel dispensing means 22 comprises at least a flow meter 9 adapted to measure the fuel flow in the at least one fuel hose 3, and at least a control valve 8 adapted to control the fuel flow in the at least one fuel hose 3 based on the fuel flow measured by the flow meter 9.

The fuel dispenser 1 comprises at least a hydraulic control unit 7 located inside the hydraulic compartment 6.

The hydraulic control unit 7 is electrically connected to a main frame control unit 5 by at least a main electric cable means 17.

A set of flow meter 9 and control valve 8 are dedicated to a fuel type (diesel or gasoline). These is one hydraulic control unit 7 per type of fuel or set of flow meter 9 and control valve 8. These flow meter 9 and control valve 8 are electrically connected by a second electric cable means 21.

Each set of flow meter 9 and control valve 8 are electrically connected to a hydraulic control unit 7. The hydraulic control units 7 of the sets of flow meter 9 and control valve 8 are connected in series together third electric cable means 23.

All the features above described for the hydraulic control unit 7 are applicable for this embodiment. The skilled person realizes that a number of modifications of the embodiments described herein are possible without departing from the scope of the invention, which is defined in the appended claims.

For instance, the main frame control unit 5 may be digitally arranged in a cloud instead of physically present in the electronic compartment 5 of the fuel dispenser 1.

The invention claimed is:

1. A fuel dispenser for refueling vehicles, comprising a hose storage space adapted to accommodate at least one fuel hose, an electronic compartment containing a main frame control unit, and a hydraulic compartment containing fuel dispensing means for delivering fuel into a vehicle reservoir, wherein the fuel dispenser comprises a hydraulic control unit controlling the fuel dispensing means, the hydraulic control unit being located inside the hydraulic compartment and being electrically connected to the main frame control unit by a main electric cable means.

2. The fuel dispenser according to claim 1, wherein the fuel dispensing means comprises at least a flow meter adapted to measure the fuel flow in the at least one fuel hose, and at least a control valve adapted to control the fuel flow in the at least one fuel hose based on the fuel flow measured by the flow meter, said flow meter and control valve being electrically connected to the hydraulic control unit by second electric cable means.

3. The fuel dispenser according to claim 1, wherein the fuel dispensing means comprises at least a fuel dispensing unit comprising a pump motor driving a pump, a flow meter adapted to measure the fuel flow delivered by the pump, and a control valve adapted to control the fuel flow delivered based on the fuel flow measured by the flow meter, said pump motor, flow meter and control valve being electrically connected to the hydraulic control unit by second electric cable means.

4. The fuel dispenser according to claim 2, wherein the fuel dispensing means comprises several fuel dispensing units that are each electrically connected to a distinct hydraulic control unit.

5. The fuel dispenser according to claim 4, wherein the hydraulic control units are electrically connected in series by third electric cable means, one of the hydraulic control units being connected to the main frame control unit by a single main electric cable means.

6. The fuel dispenser according to claim 4, wherein the hydraulic control units are each electrically connected to the main frame control unit by a distinct main electric cable means.

7. The fuel dispenser according to claim 5, wherein the main electric cable means, the second electric cable means and the third electric cable means comprise each a power alimentation line and a command line.

8. The fuel dispenser according to claim 1, wherein the main frame control unit comprises a user interface device adapted to communicate with an external environment.

9. The fuel dispenser according to claim 1, wherein the hydraulic control unit comprises at least one sensor adapted to detect a magnetic field.

10. The fuel dispenser according to claim 9, wherein the at least one sensor is a Hall effect sensor.

11. The fuel dispenser according to claim 1, wherein the electronic compartment and the hydraulic compartment are connected to the hose storage space via a column, the electronic compartment being arranged above the hydraulic compartment and in contact thereof.

12. A method for handling a fuel dispenser, comprising a hose storage space adapted to accommodate at least one fuel hose, an electronic compartment containing a main frame control unit, and a hydraulic compartment containing fuel dispensing means for delivering fuel inside a vehicle reservoir, wherein the method comprises the step of controlling the fuel dispensing means via a hydraulic control unit located in the hydraulic compartment, the hydraulic control unit being connected to the main frame control unit of the electronic compartment.

13. The method according to claim 12, further comprising:

communicating with an outer environment of the fuel dispenser, such as a user, via the main frame control unit, and updating the hydraulic control unit accordingly.

14. The method according to claim 12, further comprising:

handling the fuel dispensing means of the hydraulic compartment via the hydraulic control unit, and updating the main frame control unit accordingly.

* * * * *